US005788371A

United States Patent [19]

Neri et al.

[11] Patent Number: 5,788,371

[45] Date of Patent: Aug. 4, 1998

[54] HORIZONTAL AND VERTICAL ROTATABLE PAINT MIXING MACHINE

[75] Inventors: Sergio P. Neri, Lawrenceville, N.J.; Dennis H. Le, Willow Grove, Pa.; Barbara Ann Radzki, Monmouth Junction, N.J.

[73] Assignee: Fast America, Incorporated, Ewing, N.J.

[21] Appl. No.: 714,951

[22] Filed: Sep. 17, 1996

[51] Int. Cl.[6] ..... B01F 9/00

[52] U.S. Cl. ..... 366/217; 366/605

[58] Field of Search ..... 366/110, 111, 366/208, 209, 213, 214, 217, 219, 605

[56] References Cited

U.S. PATENT DOCUMENTS

| | | | |
|---|---|---|---|
| 3,880,408 | 4/1975 | Karjalainen | 366/217 |
| 4,281,936 | 8/1981 | Schotter et al. | 366/605 X |
| 4,445,782 | 5/1984 | Sparrow, Jr. | 366/217 |
| 4,789,245 | 12/1988 | Morbeck | 366/217 |
| 5,197,802 | 3/1993 | Miller et al. | 366/217 |
| 5,261,744 | 11/1993 | Brunn | 366/217 |

FOREIGN PATENT DOCUMENTS

| | | | |
|---|---|---|---|
| 478212 | 4/1992 | European Pat. Off. | 366/217 |
| 2809513 | 9/1979 | Germany | 366/605 |
| 91/08045 | 6/1991 | WIPO | 366/605 |

*Primary Examiner*—Charles E. Cooley
*Attorney, Agent, or Firm*—Thomas A. Beck

[57] ABSTRACT

A paint mixing machine in which the paint container is loaded into a can housing having a conical spring at the bottom of the housing which causes the paint container to engage spring locking devices thereby holding same in place as the machine rotates the can housing and paint container therein through the horizontal and vertical planes.

4 Claims, 7 Drawing Sheets

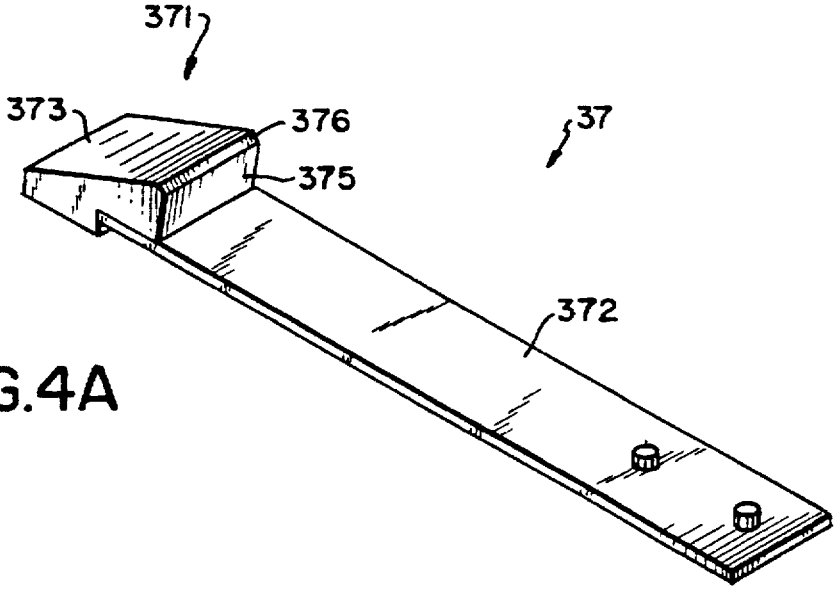
FIG.4A
FIG.4B
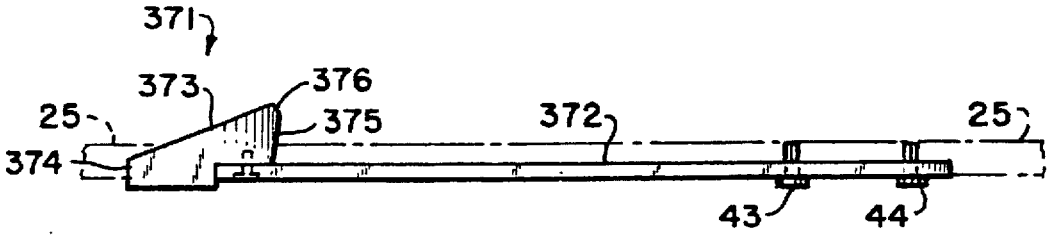
FIG.7
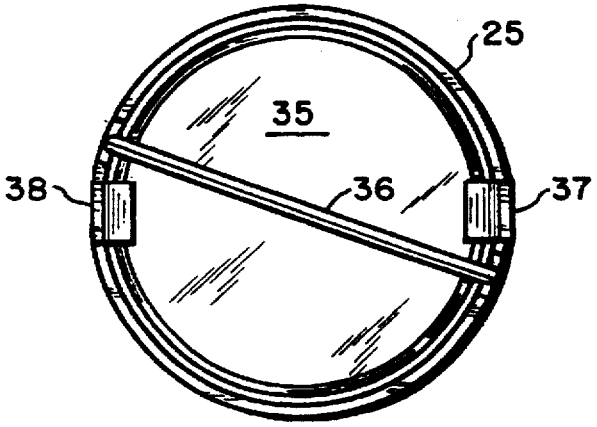

HORIZONTAL AND VERTICAL ROTATABLE PAINT MIXING MACHINE

BACKGROUND OF THE INVENTION

1. Technical Field of the Invention

The invention relates to a machine which is adapted to secure a paint container and to rotate the secured container around the horizontal and vertical axes. The machine combines efficient mixing action with ergonomically efficient top loading of the paint container into the machine.

2. Description of the Related Art

There are a number of types of paint mixing machines that are presently utilized. One type of machine is known as a "shaker." In this machine, the paint can is fixed on a tray which moves up and down in a substantially oval path along a vertical plane at reciprocating frequencies of about 500 to 600 reciprocations per minute. In this machine, the paint can is always maintained in a vertical position.

Another type of mixer presently utilized is the gyroscopic mixer wherein the paint can is clamped onto a moving system and revolves around a horizontal axis while spinning around its vertical axis.

A gyroscopic mixer found in the prior art is depicted in FIGS. 1A and 1B and is a machine comprising an external frame or chassis 100 having therein the apparatus that provides the paint mixing. The interior parts comprise a "C" frame 101 having a base 102 and a top 103. Each of the sides (as opposed to the front and back thereof) of the substantially rectangular base 102 is attached to top 103 by means of connecting rods 104, 105, 105A which pass through "C" frame 101 positioned intermediate base 102 and top 103. Adjacent the connecting rods, there are also threaded rods 106 and 107 which extend through "C" frame 101 which allow top 103 of the unit to be raised and lowered so as to be moved into contact with the paint can before the mixing operation is commenced. On the upper surface of the base and the lower surface of the top are circular rotating tables 108 and 109 which contact the top and bottom respectively of the paint can which is to be mixed. On the upper side of the top of the interior unit is a handle 110 which, when rotated, advances via the threaded rods, the upper rotating table 109 into contact with the paint can so that it is held and locked in place between the rotating tables of the basket as it is being mixed.

A shaft (not shown) is connected to the backside of the "C" frame which is connected to a pulley 111. This arrangement allows the entire "C" frame unit to rotate. Thus when the paint can is secured in position, the tables rotate the can through the horizontal axis and simultaneously, the pulley/shaft arrangement rotates the basket (and the paint) through the vertical axis.

In using this unit, the paint cannot be loaded from the top. It must be loaded from the front (i.e. a side of the chassis), and the paint can must be centered on the rotating table before it is clamped into position.

Further there are 45° rotating mixers in which the paint can is fixed in place at a 45° angle with respect the vertical axis and the can revolves around the vertical axis while concurrently spinning on its horizontal axis.

SUMMARY OF THE INVENTION

The paint mixing machine of the present invention comprises an external a chassis having a plurality of sides, a bottom and a hinged top capable of opening and closing. This feature allows the paint container to be loaded into the apparatus from the top unlike other prior art gyroscopic paint mixers. Within the chassis is an apparatus comprising a base, a wall extending substantially perpendicular upwardly from said base, and support means located diametrically opposite said wall, said support means has an upper surface supporting a plurality of pillow block bearings. Within the pillow block bearings is a rotatable shaft having a first end secured to the center of a pulley, said pulley connected to power source means by a belt and a second end secured to an "L" shaped bar having a first and a second segment. The first segment of said bar is fixed normal (i.e., 90°) to said rotatable shaft, and said second segment of said bar is normal (i.e., 90°) to said first segment and extends in a plane substantially parallel to said rotatable shaft.

There is a can housing having an interior and exterior wall and a base which is rotatably mounted to said second segment of said bar as well as an "O" ring having an inner and outer surface, said inner surface surrounding and secured to said exterior wall of said can housing, and one point of said outer surface of said "O" ring contacting said wall.

To hold the paint can in place in the can housing there are a plurality of spring locking devices, each having an upper and lower end, said lower end fixed to said exterior wall of said can housing, and said upper end having an element protruding therefrom which extends through a corresponding slot which has been cut into said wall of said can housing, into the interior of said can housing. At the bottom interior of the can housing there is a conical spring secured to said base within said can housing, said conical spring and said elements on said spring locking devices cooperating to hold in place a paint can loaded from the top of said chassis into said can housing while said paint can is being mixed by revolving simultaneously through horizontal and vertical axes.

More particularly, the paint mixing machine of the present invention comprises a can housing within the unit which, when in operation, will contain the cans of paint to be mixed. The can housing is attached to a housing support disk which is in turn attached to a shaft that rotates off of a pulley. The pulley operates off of a belt moved by any suitable means such as an AC or air motor. The pulley drives the shaft. The pulley and shaft rotate at the same rpm due to a key that locks the pulley and the shaft together. In general, the motor will operate a higher rpm than that of the pulley and shaft. To support the shaft, there are two pillow block bearings which allow the shaft to rotate freely and minimize the fluctuation on the system. The bottom of the can housing is secured to the housing support disk via two radial ball bearings which allow the housing to rotate freely as to the horizontal shaft. When the motor is actuated, the pulley transmits power to the shaft which rotates the can housing 360° through its vertical axis, i.e. the top of the can when in place in the can housing will rotate over itself. On the exterior of the can housing, an O-ring is placed in contact with an interior wall of the unit. Thus, as the can housing rotates, the unit's interior wall supplies a source of friction between it and the O-ring on the can housing. This friction causes the can housing to rotate through the horizontal axis. Thus, the paint within the can in the can housing is mixed by movement of the can housing in both the horizontal and vertical axes and is referred to hereinafter as gyroscopic action.

To secure the paint can from falling from the housing as the system operates, spring locking devices keep the paint can in position. The can housing also contains a conical spring load located inside the base of the can housing. The conical spring load is intended to elevate the paint can and to keep it under pressure when secured by the locking devices used to hold the paint can within the can housing.

This conical spring load also enables the user to easily unload the paint can by simply pulling the spring locking devices away from each other. The biased spring will immediately advance the paint can upward so that the lid of the paint can will then be situated above the portions of the spring locking devices that hold the paint can in place within the can housing.

The advantages of the unit of the present invention are that it provides gyroscopic mixing action for both gallon and quart cans of paint. It allows loading from the top; also, it provides clampless loading into the unit unlike the special measures needed in the prior art units to hold the paint can in place. Due to its compact size the unit can be placed on a countertop.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

DESCRIPTION OF THE DRAWINGS

In the drawings:

FIGS. 4A and 4B are oblique and side views of the spring locking device.

FIG. 7 is a top view of the can housing with the clamps in place.

DETAILED DESCRIPTION OF THE PRESENTLY PREFERRED EMBODIMENTS

Figure 1A:
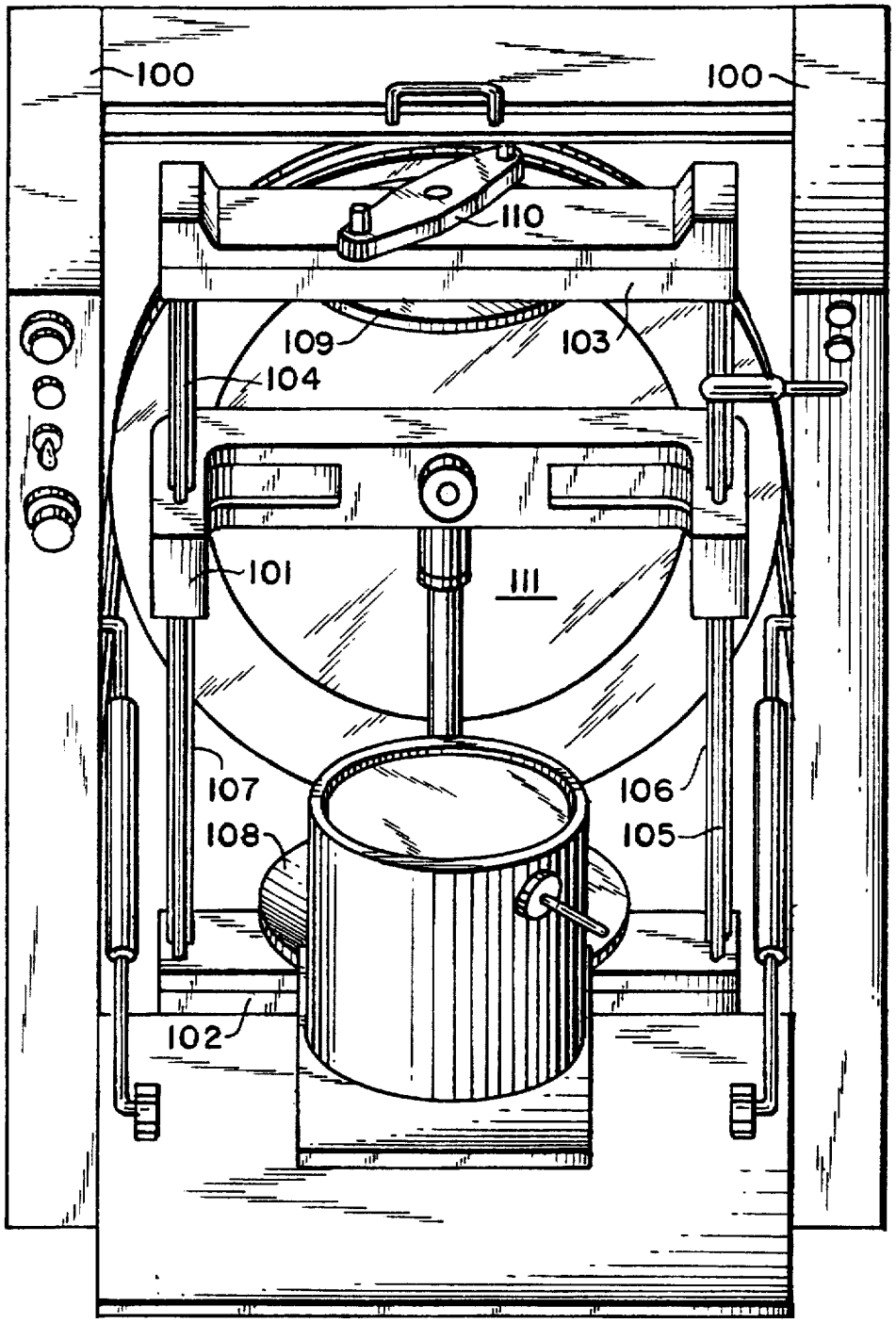
FIG.1A PRIOR ART
FIG. 1A is a front view of a prior art machine.
Figure 1B:
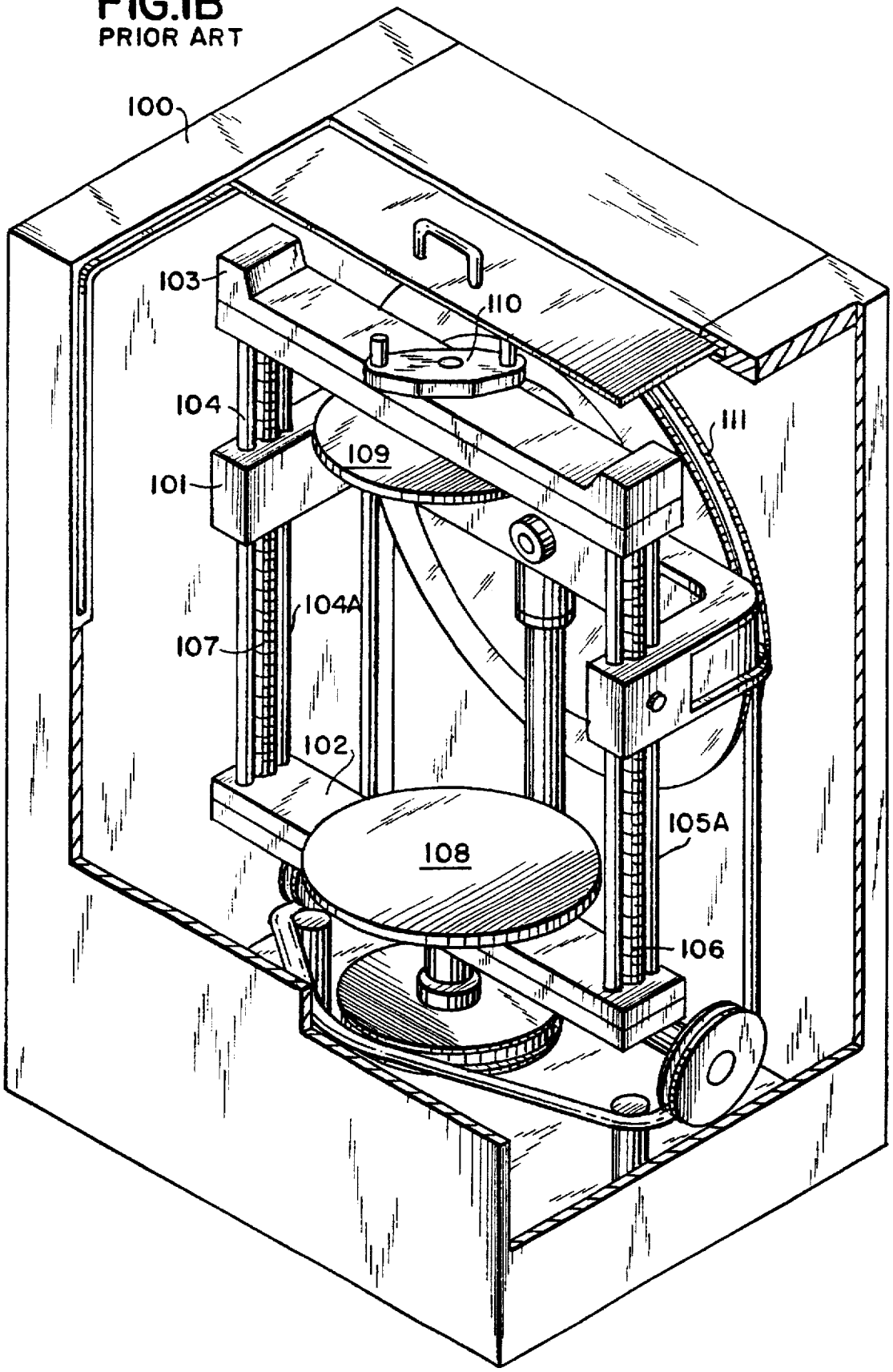
FIG.1B PRIOR ART
FIG. 1B is an orthogonal view of the machine shown in FIG. 1A
Figure 2:
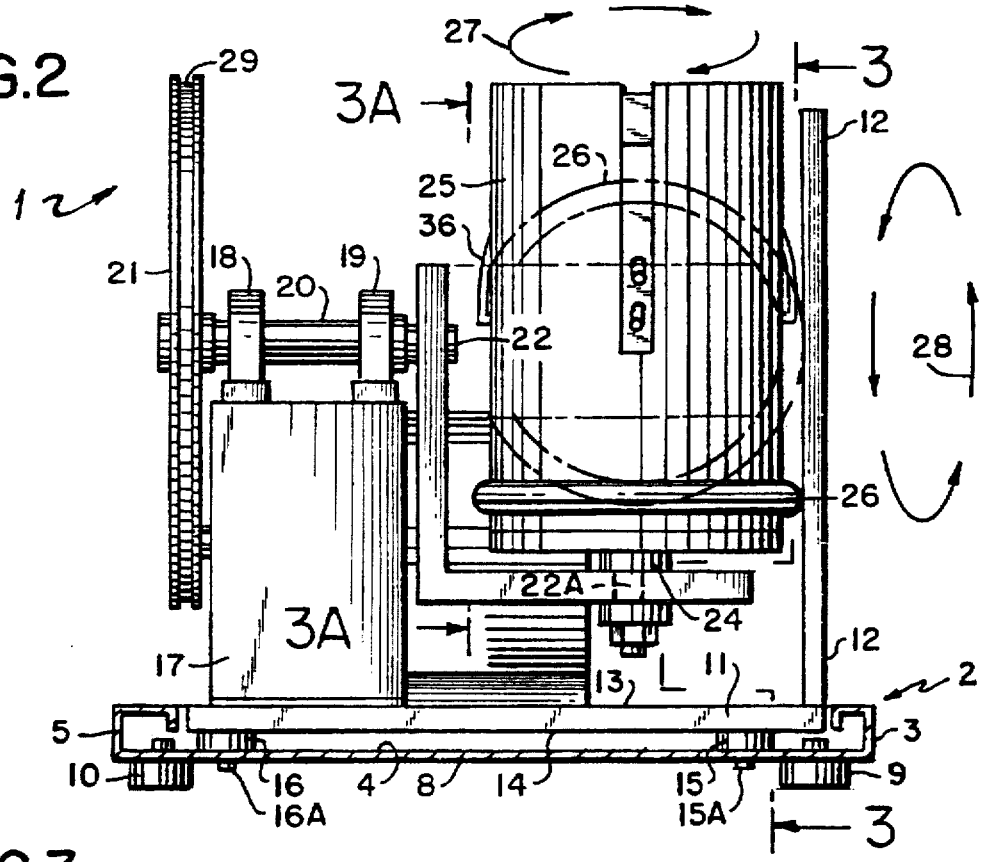
FIG. 2 is a front view of the machine of the present invention.

In FIG. 2 paint mixing machine 1 is a portable compact unit suitable for mixing refinishing and/or decorative interior and exterior paints in the size cans generally sold at retail outlets. The paint mixing machine of the present invention is conveniently fixedly contained within a chassis (not shown) comprising a frame having a top, bottom and sides generally of the type exemplified and depicted in FIGS. 1A and 1B. The chassis also contains a hinged panel or door allowing access to the interior of the chassis so that a paint container to be mixed can be inserted onto and withdrawn from the paint mixing machine. Machine 1 is supported on an external plate 2. External plate 2 has the general configuration of a tray since it has sides 3, 4 and 5, as well as plate top 7 and plate bottom 8. The fourth (back) side is not shown. Extending from bottom side 8 are a plurality of adjustable feet 9 and 10. A convenient way of forming base 11 and wall 12 is to take a single metal sheet and bend one end 90°. The unit is secured to a base 11 which can take the form of an inverted tray; that is the sides of same extend downwardly toward top 7 of external plate 2. Base 11 also has a top 13 and bottom 14. Wall 12 extends upwardly from and is a continuous upward extension of top 13 of base 11. Secured to bottom 14 are a plurality of anti-vibrational feet 15, 16 which are secured at their other ends to external plate 2 by securing means 15A and 16A. Secured to top side 13 of base 11 is bearings support 17 which support pillow blocks 18 and 19. Shaft 20 is actuated by pulley 21 and is held in place by pillow block bearings 18 and 19. Fixed to shaft 20 is a unitary "L" shaped right angle shaft or bar including 22 and 22A Shaft or bar 22 may optionally consist of two elements fixed at right angle. Extending through shaft or bar 22A is can housing support disk 24 to which can housing 25 is attached. Around the exterior circumference of can housing 25 is O-ring 26 which is in contact with the interior surface of wall 12. Circular arrows 27 and 28 depict the rotation of the housing when the machine is in operation.

Figure 3:
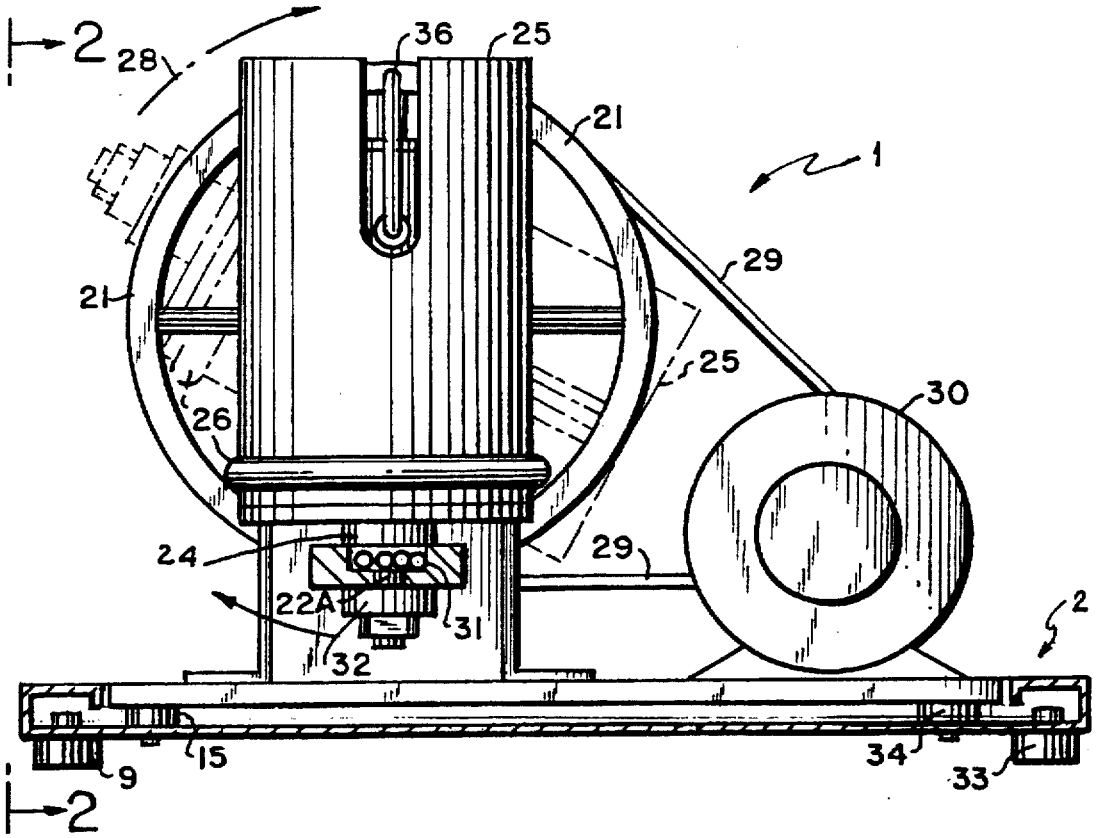
FIG. 3 is a side view of the machine of the present invention as indicated in FIG. 2.
Figure 2A:
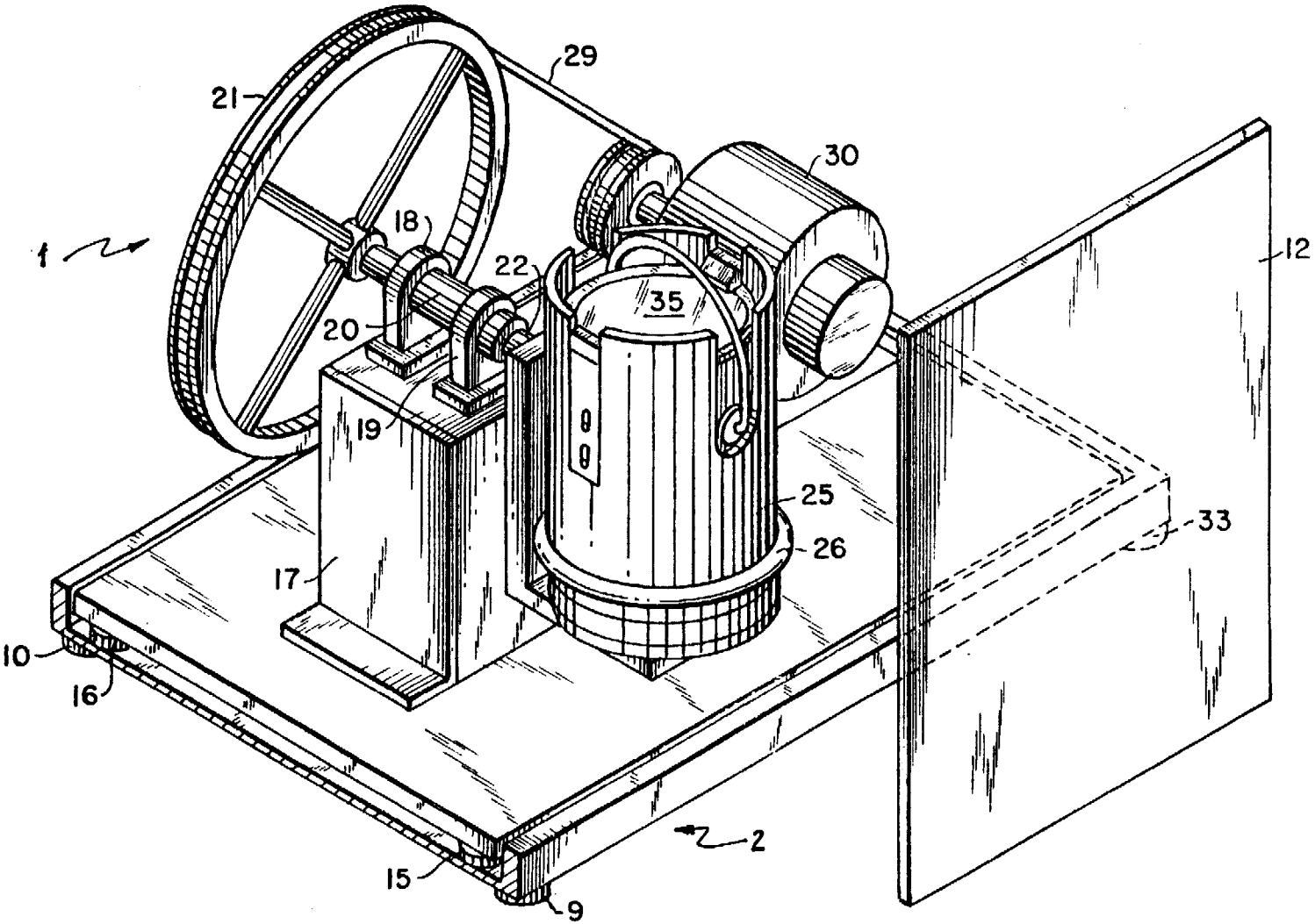
FIG. 2A is an orthogonal view of the machine of the present invention.

FIG. 3 depicts pulley 21 which is driven by a belt 29 of motor 30. Radial ball bearings 31 and 32 which are placed beneath can housing support disk 24 allow shaft 22A to freely rotate. The side view of FIG. 3 shows adjustable feet 9 and 33 and shows anti-vibrational feet 15 and 34.

Referring to FIG. 3, when motor 30 is actuated, pulley 21 in cooperation with belt 29 rotates so that shaft 20 also rotates in the same plane as the pulley. As a result, can housing 25, with paint can 35 (not visible) therein rotates through the horizontal plane. Concurrently, O-ring 26 is in contact with wall 12 as shaft 20 is rotating, thereby moving in a circular arc, can housing 25 attached to shaft 22–22A. The frictional contact between O-ring 26 and wall 12 during the course of the 360° arc, rotates can housing 25. Thus, the paint within the can is subjected to 360° rotation along its vertical and horizontal axes as indicated by broken lines 26 showing the top of the unit during a rotation cycle, and arrows 27 and 28.

Figure 3A:
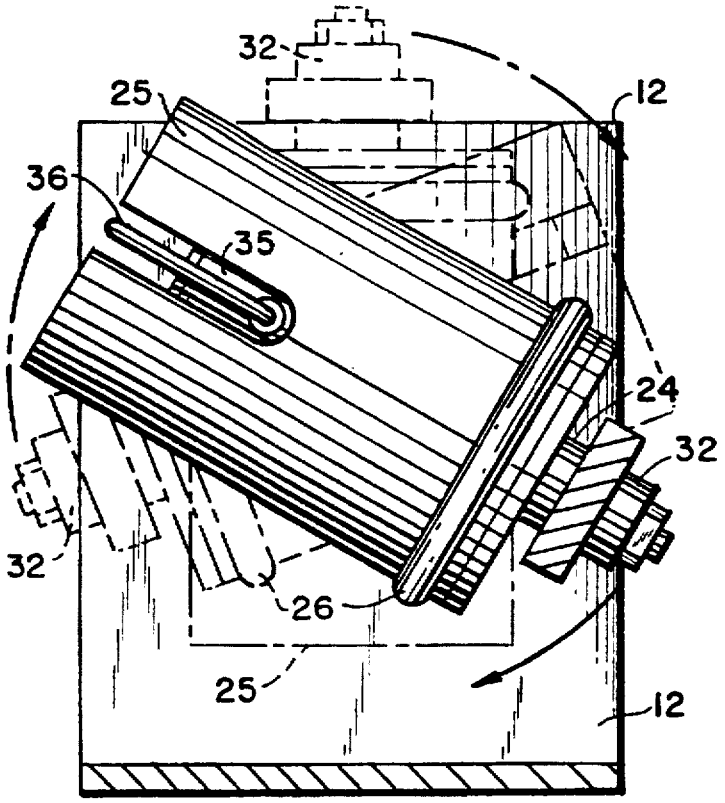
FIG. 3A is a side view of the machine of the present invention as indicated in FIG. 2.

FIG. 3A is the opposite side view of the side view presented in FIG. 3, both of which are indicated in FIG. 2. Can housing 25, containing paint can 35 therein is depicted by broken lines and bearings 32 at various angles as it rotates 360° through the horizontal plane. O-ring 26 is in contact with wall 12. The frictional contact between O-ring 26 and wall 12 during the course of the 360° arc, rotates can housing 25. The paint within the can is subjected to 360° rotation throughout its vertical and horizontal axes.

Figure 4:
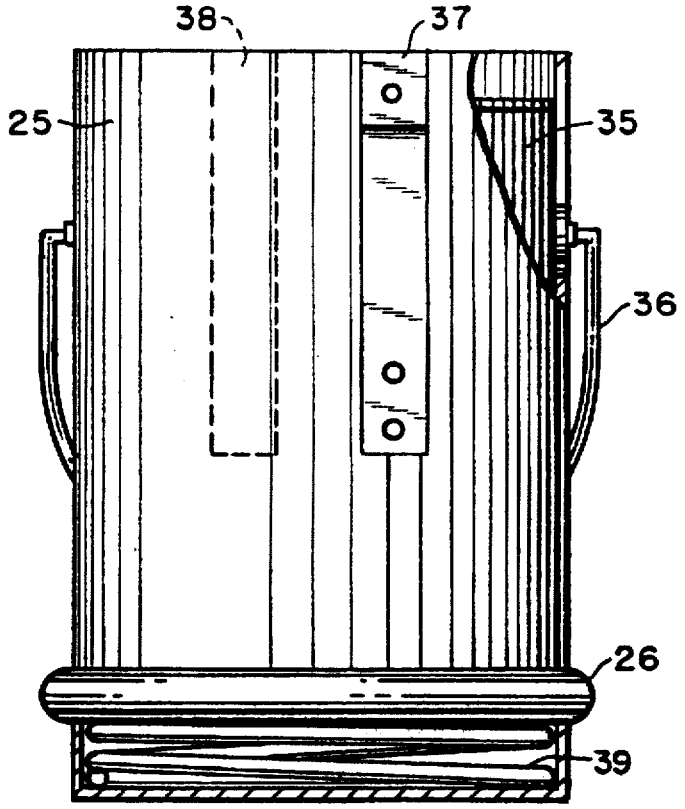
FIG. 4 is a detailed view of the can housing showing the O-ring and compression conical spring along with the spring locking device that holds the paint can within the housing.

FIG. 4 depicts the can housing 25 having within it paint can 35 containing handle 36. Spring locking device 37 is visible and the position of corresponding spring locking device 38 on the other side of the can housing 25 is visible by the broken lines. Within can housing 25 there is conical spring 39 which is in a non-compressed state when paint can 35 is placed initially within can housing 25. It rests upon conical spring 39. Paint can 35 is secured within can housing 25 by applying pressure to the top thereof to compress conical spring 39 whereupon spring locking devices 37 and 38 are set in place over the top of paint can 35 and the compression from the conical spring tending to push upward holds paint can 35 within can housing 25 in place during the mixing operation.

Figure 5:
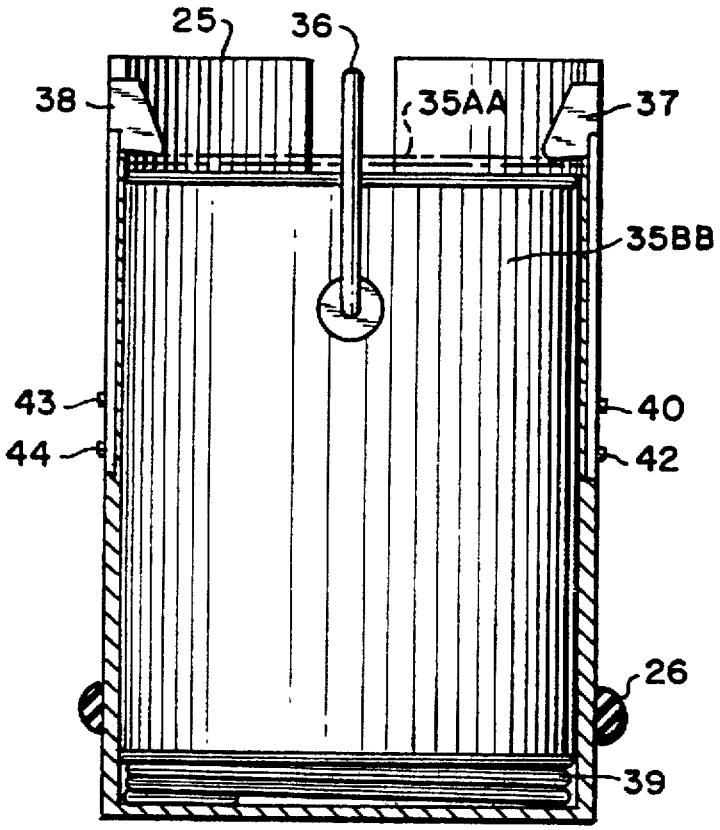
FIG. 5 shows the paint can in place with the conical spring compressed.

FIG. 5 depicts the can housing 25 before (35AA) and after (35BB) compressing conical spring 39 and spring locking devices 37 and 38 in place.

Spring locking devices 37 and 38 are preferably made of a quality sheet steel that has strength as well as flexibility. They are fixed to the side of can housing 25 using any suitable means such as screws 40, 44, 42 and 43. Spring locking devices 37 and 38 contain a head 371 extending from a metal strip section 372 made from a malleable and flexible material such as stainless steel to permit repeated movement of the spring locking devices 37 and 38 away from the can housing without fracturing the metal strip section 372 of the spring locking device.

As shown in FIG. 4A, the head 371 of spring locking device 37 has a sloped section 371 extending from the apex 374 of the triangular cross section formed in conjunction with the extension of strip section 372 and the base 375 of head section 371. The intersection 376 formed by sloped section 373 and base section 375 may be beveled (as shown) to fit within the furrows between the ridges which secure the lid of paint can 35 and holds the can in place during the mixing step.

Can housing 25 may have sections cut out of the sides thereof to accommodate the heads of spring locking device 37.

Figure 6:
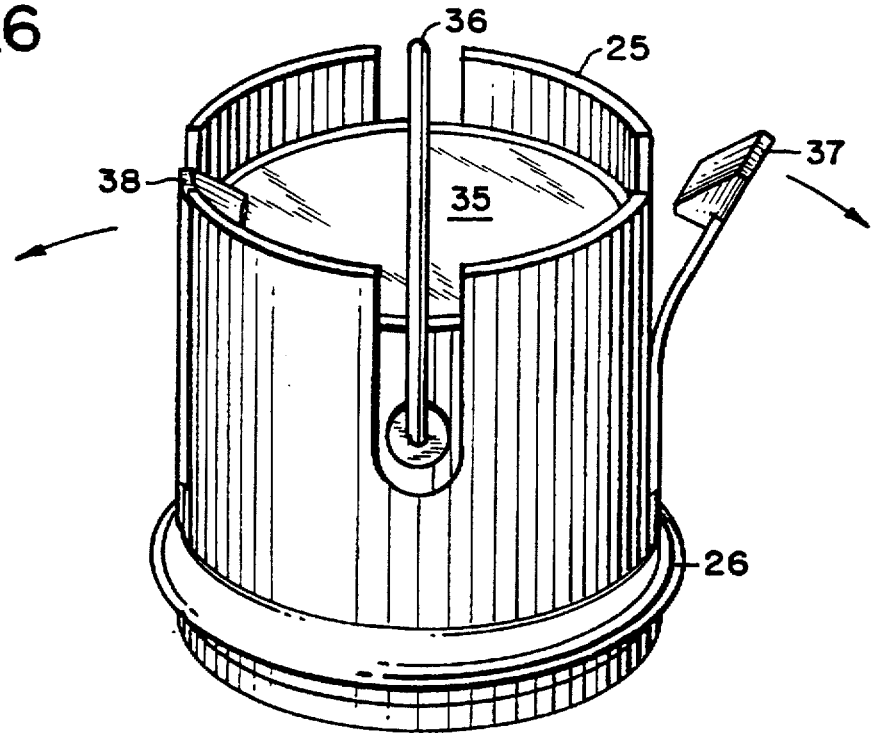
FIG. 6 is a side view of the can housing showing the spring locking devices.

As depicted in FIG. 6, the conical spring pressure upward against the can pushes the top of the can flush against the spring locking devices 37 and 38 and paint can 35 is held in place. To release paint can 35, the spring locking devices 37 and 38 are pulled back and away from the top of paint can 35 and conical spring 39 under compression moves paint can 35 up so that it can be retrieved by the operator after the operation is completed.

FIG. 7 depicts the top of spring locking devices 37 and 38 as they are securing the paint can in position.

The invention is not limited by the embodiments described above which are presented as examples only but can be modified in various ways within the scope of protection defined by the appended patent claims.

What we claim and desire to protect by Letters Patent is:

1. A paint mixing machine comprising:

a base;

a wall extending substantially perpendicular upwardly from said base;

support means located diametrically opposite said wall, said support means having an upper surface supporting a plurality of pillow block bearings;

a rotatable shaft within said pillow block bearings and having a first end secured to the center of a pulley, said pulley connected to power source means by a belt;

said rotatable shaft having a second end secured to an "L" shaped bar having a first and a second segment, wherein said first segment of said bar is fixed normal to said rotatable shaft, and said second segment of said bar is normal to said first segment and extends in a plane substantially parallel to said rotatable shaft;

a can housing having an interior and exterior wall and a base which is rotatably mounted to said second segment of said bar;

an "O" ring having an inner and outer surface, said inner surface surrounding and secured to said exterior wall of said can housing, and one point of said outer surface of said "O" ring contacting said wall;

a plurality of spring locking devices, each having an upper and lower end, said lower end fixed to said exterior wall of said can housing, and said upper end having an element protruding therefrom which extends through a corresponding slot in said wall of said can housing, into the interior of said can housing;

a conical spring secured to said base within said can housing;

said conical spring and said elements on said spring locking devices cooperating to hold in place a paint can loaded from the top of said chassis into said can housing wherein the contents of said paint can are mixed by revolving said paint can simultaneously through horizontal and vertical axes.

2. The paint mixing machine defined in claim 1 wherein said base from which said wall extends substantially perpendicular upwardly, rests upon an external plate having adjustable feet.

3. The paint mixing machine defined in claim 2 wherein each said element of said spring locking devices possesses a beveled edge that engages the top of the paint can and holds the top of said paint can in position when the contents of said paint can are mixed by revolving said paint can simultaneously through horizontal and vertical axes.

4. A method of mixing paint in a can in the machine defined in claim 1 which comprises loading said paint can into said can housing and forcing said can to compress said conical spring so that said paint can is held in place by said elements on said spring locking devices.

* * * * *